US008457862B2

(12) United States Patent
Pfeiffer

(10) Patent No.: US 8,457,862 B2
(45) Date of Patent: Jun. 4, 2013

(54) METHOD FOR CONTROLLING AND DIAGNOSING A VANE-TYPE CAM PHASER HAVING INTERMEDIATE POSITION PIN LOCKING

(75) Inventor: Jeffrey M. Pfeiffer, Frankenmuth, MI (US)

(73) Assignee: Delphi Technologies, Inc., Troy, MI (US)

( * ) Notice: Subject to any disclaimer, the term of this patent is extended or adjusted under 35 U.S.C. 154(b) by 1024 days.

(21) Appl. No.: 12/157,908

(22) Filed: Jun. 13, 2008

(65) Prior Publication Data

US 2009/0312937 A1 Dec. 17, 2009

(51) Int. Cl.

| | |
|---|---|
| ***G06F 19/00*** | (2011.01) |
| ***G06G 7/70*** | (2006.01) |
| ***F01L 1/34*** | (2006.01) |

(52) U.S. Cl.

USPC ..... 701/101; 701/114; 123/90.15

(58) Field of Classification Search

USPC ..... 701/114, 101, 102; 123/90.15, 90.16, 123/90.18, 90.31, 90.17

See application file for complete search history.

(56) References Cited

U.S. PATENT DOCUMENTS

| | | | | |
|---|---|---|---|---|
| 5,467,748 | A * | 11/1995 | Stockhausen | 123/198 F |
| 5,937,806 | A * | 8/1999 | Lyko et al. | 123/90.15 |
| 6,443,112 | B1 * | 9/2002 | Kinugawa | 123/90.17 |
| 6,637,390 | B1 * | 10/2003 | Dauer et al. | 123/90.17 |
| 2007/0062474 | A1 * | 3/2007 | Lipke et al. | 123/90.17 |

* cited by examiner

*Primary Examiner* — Stephen K Cronin
*Assistant Examiner* — Sherman Manley
(74) *Attorney, Agent, or Firm* — Thomas N. Twomey

(57) ABSTRACT

An improved control and diagnostic algorithm for coordinating the operation and checking reliability of oil control valves for a vane-type camshaft phaser in an internal combustion engine. A first oil control valve governs the rotational position of the phaser rotor within the stator, and a second oil control valve controls the locking and unlocking of a locking pin operable between the rotor and the stator. The algorithm determines when a change is needed in the position of the locking pin, commands the rotor to a predetermined angular position to permit the position change to be carried out, determines whether the commanded change was carried out successfully, and reports instances wherein the commanded locking pin position change was unsuccessful.

7 Claims, 2 Drawing Sheets

METHOD FOR CONTROLLING AND DIAGNOSING A VANE-TYPE CAM PHASER HAVING INTERMEDIATE POSITION PIN LOCKING

TECHNICAL FIELD

The present invention relates to vane-type camshaft phasers for varying the phase relationship between a crankshaft and a camshaft in an internal combustion engine; more particularly, to such phasers wherein a locking pin is utilized to lock the phaser rotor with respect to the stator at a rotational position intermediate between full timing advance and full timing retard positions; and most particularly to a method for controlling and diagnosing the performance of an intermediate-locking-position (ILP) camshaft phaser.

BACKGROUND OF THE INVENTION

In a typical prior art vane-type cam phaser, a controllably selective locking pin is slidingly disposed in a bore in a rotor vane to permit rotational locking of the rotor to the stator (or sprocket wheel or pulley) under certain conditions of operation of the phaser and engine. In ILP camshaft phasers, the rotor is lockable to the stator at an intermediate position in an increased rotor range of rotational authority. The position of the rotor is governed by application of pressurized oil to one side or the other of the rotor vanes via an oil control valve (OCV). The timing of engine combustion valve events can be varied continuously by controlling oil pressure through the OCV to the cam phaser attached to the camshaft. In one type of ILP camshaft phasers, a separate oil ILP control valve is used to control oil flow to the ILP locking pin with a separate command from the ECU.

The addition of an intermediate locking pin and accompanying ILP control valve introduces new control requirements for an engine management system (EMS). The present invention relates to a specific control method and diagnostic for ILP cam phasing. The invention comprises a strategy for controlling the OCV and ILP duty cycles together so that the cam phaser is operated and diagnosed correctly at all engine operating conditions.

What is needed in the art is a method and diagnostic for ILP camshaft phasing.

It is a principal object of the present invention to improve the operation and reliability of an ILP camshaft phaser.

SUMMARY OF THE INVENTION

Briefly described, a vane-type camshaft phaser in accordance with the invention for varying the timing of combustion valves in an internal combustion engine is controlled by an OCV that governs the rotational position of the rotor within the stator, and an ILP Valve that controls the locking and unlocking of a locking pin operable between the rotor and the stator. An improved control and diagnostic algorithm coordinates the operation and reliability checking of the OCV and ILP valves.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
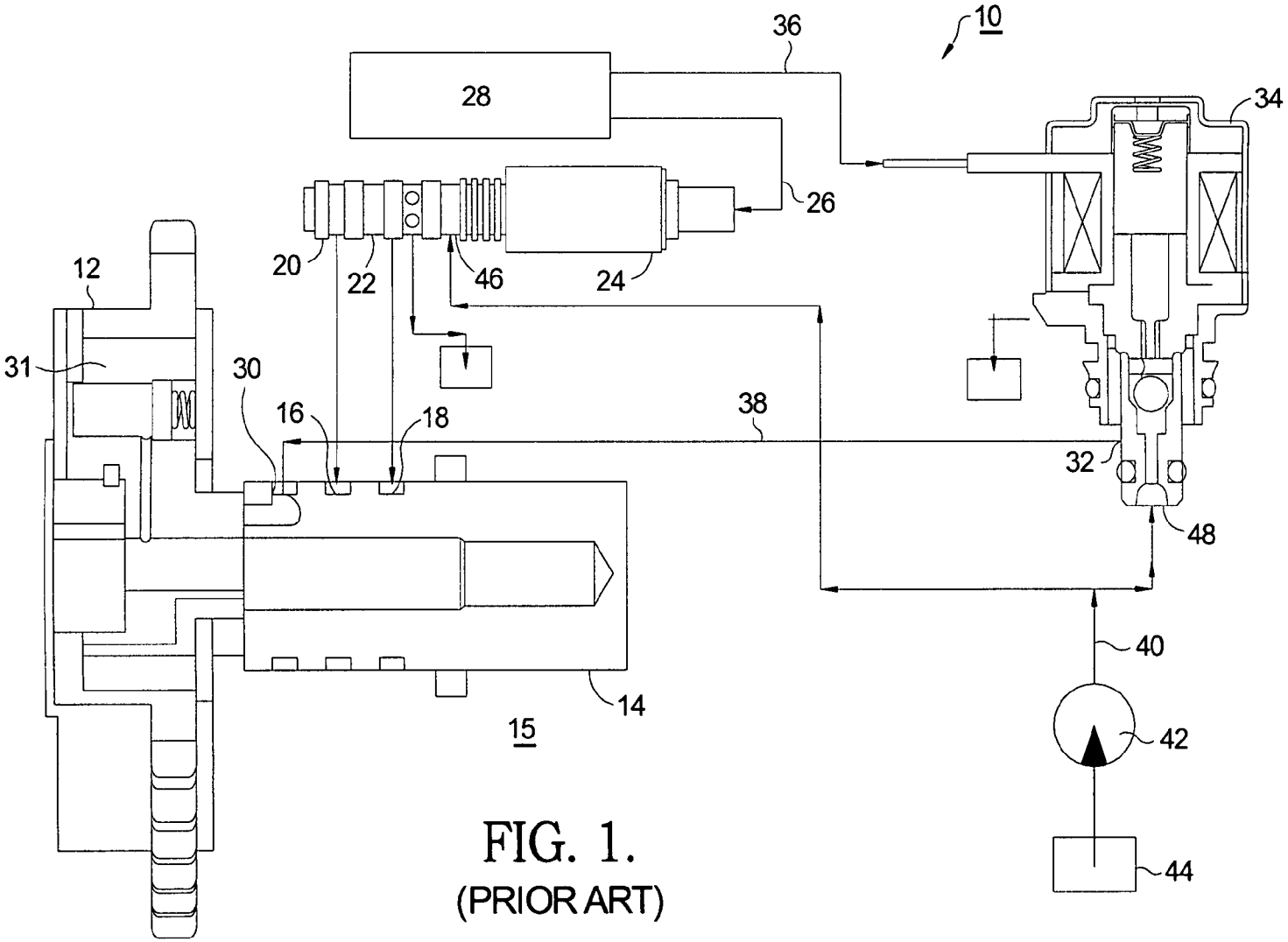
FIG. 1. (PRIOR ART)
FIG. 1 is a schematic view of a prior art control system for a vane-type camshaft phaser, that is subject to improved operational control in accordance with a method of the present invention.

Referring to FIG. 1, in a prior art control system 10 for operating a vane-type camshaft phaser 12, the phaser 12 is shown mounted on the end of a camshaft 14 of an internal combustion engine 15. Camshaft 14 is provided with oil access ports 16,18 in communication respectively with oil supply ports 20,22 in an OCV 24 (typically, a spool valve that may be shuttled between positions) in communication with respective advance and retard chambers within phaser 12 and responsive to control signals 26 from an Engine Control Module (ECM) 28 to vary the rotational position of a rotor within a stator of phaser 12 in known fashion. Camshaft 14 is further provided with a third oil access port 30 in communication with an Intermediate-position Locking Pin (ILP) 31 within the rotor and with an oil supply port 32 in an ILP control valve 34 (typically a poppet valve that is either open or closed) responsive to control signals 36 from ECM 28 to provide pressurized oil output 38 to change the position of the ILP 31 to lock or unlock the rotor from the stator in known fashion. Pressurized engine oil 40 is supplied via a pump 42 from an oil sump 44 to an entrance port 46 in OCV 24 and to an entrance port 48 in ILP valve 34.

Figure 2:
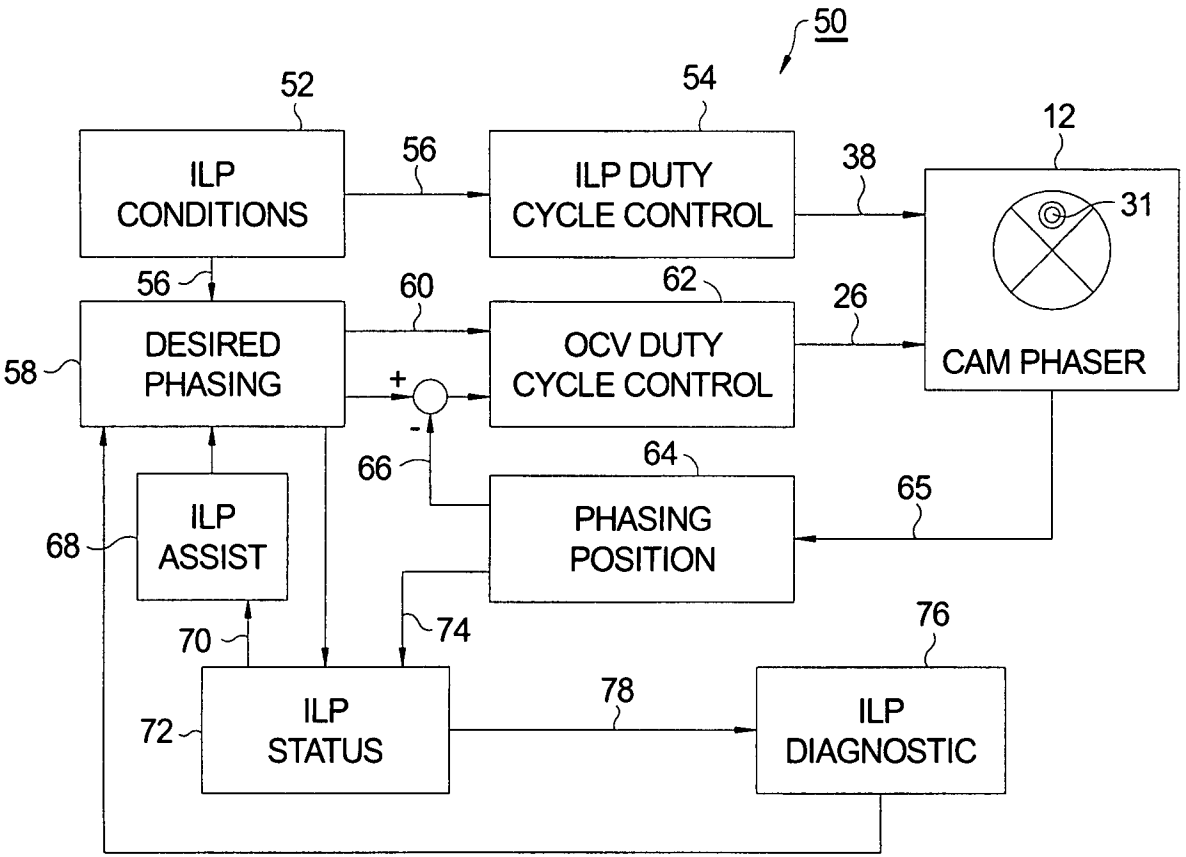
FIG. 2 is a schematic diagram of a control algorithm in accordance with the present invention.

Referring to FIGS. 1 and 2, a schematic diagram 50 is shown of an improved control and diagnostic system for ILP phaser 12 and engine 15, in accordance with the present invention.

ILP Conditions 52: This function is responsible for determining that an ILP state change (locking or unlocking) is needed. For example, the ILP state must change at startup and at shutdown of the engine to disengage or engage the ILP between the rotor and the stator. The ILP conditions 52 are based on engine state (a variable describing what operating mode the engine is in) and engine speed as monitored by ECM 28.

ILP duty cycle control 54: The output 38 of ILP valve 34 must react to the request 56 from ILP conditions to change the state of the command to the ILP valve. The ILP valve output 38 preferably is discrete, but the energizing of the valve may be used to either engage or disengage the ILP. Both options are covered by this function.

Desired phasing 58: The request for ILP state change 56 is delivered simultaneously to the desired phasing logic 58 so that the phasing position can be controlled toward the lock pin location while the ILP state change is occurring. This is the most critical function of the control (i.e. the simultaneous delivery of commands to both ILP valve 34 and phasing OCV 24, the latter through 'Desired Phasing'). When the engine is to be shut down, the objective is to move the rotor to the default position and to engage the lock pin into the stator before the engine stops. This process bypasses normal phasing commands when an impending engine stop is detected. Where normally in some engine operating conditions the desired phasing may be directed to some idle schedule or some deceleration schedule, engine-stop ILP conditions will immediately drive the desired phasing to default so that the locking pin can be engaged. The default position is defined herein as a predetermined angular position of the rotor, preferably although not necessarily at an intermediate position of the rotor range of authority.

Active phasing is commanded 60 to enable OCV duty cycle control 62 wherein OCV 24 is dithered according to a pulse-width modulation (PWM) duty cycle control signal 26 to drive the rotor to a desired angular position within the stator. The phasing position 64 is sensed 65 and fed back 66 in a closed feedback loop to duty cycle control 62.

ILP Assist 68: The desired phasing logic 58 also contains a lock pin assist function 68 that receives information 70 from an ILP Status function 72. In the event that the lock pin status indicates that the lock pin has failed to disengage, lock pin assist 68 will restrict the rotor phasing to a rotational position near default. This assists in disengaging the lock pin by preventing large position errors to be delivered to the phasing position control algorithm. Such large position errors translate into large duty cycles, which translate into large rotational forces on the rotor which side load the lock pin and can prevent it from disengaging.

ILP Status 72: There are four possibilities for ILP status: 1) disengagement successful, 2) disengagement failed, 3) engagement successful, and 4) engagement failed. Each of these status results is determined based on desired and actual position 74 (or desired position and position error) of the rotor. If the desired phasing position is not zero (default) and exceeds a predetermined threshold value, and the ILP has been commanded to disengage, then the lock pin status function checks for disengagement. Conversely, if the desired rotor position is zero, and the ILP is commanded to engage, then the lock pin status function checks for engagement. In each case, the position error is compared to a threshold value, to indicate the success or failure for disengagement or engagement.

For example, if both the desired position and the position error have the same value, and both are greater than a threshold value, then the indicated ILP status is "disengagement failed" (rotor didn't move). If the desired position is zero with the ILP commanded to engage, and the position error is still greater than a threshold value, then the indicated ILP status is "engagement failed" (rotor not in position for pin to engage). All criteria for status determination use a timing counter to establish the condition for a minimum period before reporting the status.

ILP Rationality Diagnostic 76: The ILP phaser 12 must be diagnosed since it is a controlled part of engine 16. An output diagnostic is required for the ILP control valve 34, but a rationality diagnostic is also required. The ILP rationality diagnostic 76 is fed 78 by the ILP status function 72. When the ILP status function 72 is either "disengagement failed" or "engagement failed", then the ILP rationality diagnostic fail criteria are met. The diagnostic counts the number of executions wherein the fail criteria are met, and if the failure criteria are met for a minimum period of time, the diagnostic is considered failed and a malfunction code is stored and reported or alarmed. The diagnostic failure is cleared or passed when the ILP status function 72 is changed to "disengagement successful" or "engagement successful" for a minimum period of time.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for controlling and diagnosing performance of a camshaft phaser in an internal combustion engine wherein the camshaft phaser includes a vaned rotor disposed within a stator for phasing of the camshaft with respect to the engine crankshaft and a locking pin disposed within the rotor for locking the rotor to the stator at a predetermined angular position of the rotor, the method comprising the steps of:

a) determining when a change is needed in the position of said locking pin, wherein said position of said locking pin determines if said rotor is locked to said stator to prevent relative rotation of said rotor with said stator or if said rotor is unlocked from said stator to permit relative rotation of said rotor with said stator;

b) commanding said needed change in the position of said locking pin;

c) commanding said rotor to said predetermined angular position to permit said commanded locking pin position change to be carried out when said change is required;

d) determining whether said commanded locking pin position change was carried out successfully;

e) determining a rotor position error based on a desired and actual rotor position and;

f) comparing the rotor position error to a predetermined threshold value.

2. A method in accordance with claim 1 further including the step of reporting instances wherein said commanded locking pin position change was unsuccessful.

3. A method in accordance with claim 1 wherein said predetermined angular position is intermediate between a full advance position and a full retard position of said rotor within said stator.

4. A method in accordance with claim 1 wherein said phasing is controlled by a first oil control valve and wherein said locking pin position is controlled by a second oil control valve.

5. A method in accordance with claim 1 further comprising the step of restricting desired phasing to a position near said predetermined angular position to assist in said changing of locking pin position when said commanded locking pin position change is determined to have been unsuccessful in said determining step.

6. A method in accordance with claim 1 wherein said step of commanding said rotor to said predetermined angular position to permit said position change to be carried out when said change is required overrides any other rotor-position command in force at the time of said commanding step.

7. A method in accordance with claim 1 wherein said step of commanding said needed change in the position of said locking pin and said step of commanding said rotor to said predetermined angular position are carried out simultaneously.

* * * * *